US012575689B2

(12) United States Patent
Hagstrom et al.

(10) Patent No.: US 12,575,689 B2
(45) Date of Patent: Mar. 17, 2026

(54) DISPENSING SYSTEM WITH CONTROLLED AIR CIRCULATION

(71) Applicants: Gregory A. Hagstrom, Cincinnati, OH (US); Kevin Klueber, Middletown, OH (US)

(72) Inventors: Gregory A. Hagstrom, Cincinnati, OH (US); Kevin Klueber, Middletown, OH (US)

(73) Assignee: APEX INDUSTRIAL TECHNOLOGIES LLC, Mason, OH (US)

( * ) Notice: Subject to any disclaimer, the term of this patent is extended or adjusted under 35 U.S.C. 154(b) by 209 days.

(21) Appl. No.: 18/534,100

(22) Filed: Dec. 8, 2023

(65) Prior Publication Data

US 2024/0188731 A1 Jun. 13, 2024

Related U.S. Application Data

(60) Provisional application No. 63/431,467, filed on Dec. 9, 2022.

(51) Int. Cl.
*A47F 3/04* (2006.01)
*A47F 10/02* (2006.01)

(52) U.S. Cl.
CPC ..... *A47F 3/0408* (2013.01); *A47F 3/0426* (2013.01); *A47F 10/02* (2013.01); *A47F 2010/025* (2013.01)

(58) Field of Classification Search
CPC ..... A47F 3/0426; A47F 3/043; A47F 10/02; A47F 2010/025; A47G 29/141;
(Continued)

(56) References Cited

U.S. PATENT DOCUMENTS 4,024,729 A * 5/1977 Abate, Sr. ..... F25D 23/10 62/263
5,069,273 A 12/1991 O'Hearne
(Continued)

FOREIGN PATENT DOCUMENTS

| | | |
|---|---|---|
| EP | 2750971 B1 | 7/2014 |
| WO | 2015130329 A1 | 9/2015 |
| WO | 2018022503 A1 | 2/2018 |

OTHER PUBLICATIONS

U.S. Patent and Trademark Office, International Search Report and Written Opinion, International Application No. PCT/US2023/083165, 10 pages, Apr. 2, 2024.
"OrderHQ* 103-104FT Flow-Thru Countertop Lockers," Apex Order Pickup Solutions, 5 pages, 2021.
"OrderHQ 107-108FT/FL Flow-Thru & Front-Load Floor Lockers," Apex Order Pickup Solutions, 6 pages, 2021.

*Primary Examiner* — Joseph F Trpisovsky
(74) *Attorney, Agent, or Firm* — Thompson Hine LLP

(57) ABSTRACT

An order fulfillment system having a frame defining a compartment therein that extends between a first space and a second space, and a first door coupled to the frame. The first door is movable between an open position providing access to the compartment from the first space, and a closed position blocking access to the compartment from the first space. The system further includes a second door coupled to the frame, wherein the second door is movable between an open position providing access to the compartment from the second space, and a closed position blocking access to the compartment from the second space. The system is configured such that the compartment has greater fluid communication with the first space compared to the second space when the first door is in the closed position and the second door is in the closed position. The system also includes an air movement device in fluid communication with the first
(Continued)

space and the compartment, wherein the air movement device is configured to provide air from the first space into the compartment.

24 Claims, 9 Drawing Sheets

(58) Field of Classification Search
CPC ..... A47G 2029/145; A47G 2029/147; G07F 17/12; G07F 9/105; F25D 23/02; F25D 23/025; F25D 23/028; F25D 13/02; F25D 13/067; F25D 17/04; F25D 17/06; F25D 17/08
See application file for complete search history.

(56) References Cited

U.S. PATENT DOCUMENTS

| | | | | |
|---|---|---|---|---|
| 6,079,216 | A * | 6/2000 | de Marsillac Plunkett | A47G 29/20 312/286 |
| 6,484,531 | B1 * | 11/2002 | Hambleton | F25D 23/10 312/286 |
| 2008/0017045 | A1 | 1/2008 | McGuire | |
| 2011/0283895 | A1 | 11/2011 | Veltrop | |
| 2019/0344930 | A1 | 11/2019 | Jessie | |
| 2019/0362302 | A1 | 11/2019 | Deemter | |
| 2021/0047165 | A1 | 2/2021 | Showalter | |
| 2021/0235891 | A1 | 8/2021 | Derosa | |
| 2021/0390817 | A1 | 12/2021 | Ambauen | |

* cited by examiner

DISPENSING SYSTEM WITH CONTROLLED AIR CIRCULATION

This application claims priority to U.S. Provisional Patent Application Ser. No. 63/431,467, filed on Dec. 9, 2022, the entire contents of which are hereby incorporated by reference.

This application is directed to an order fulfillment system, and more particularly, to an order fulfillment system with controlled air circulation.

BACKGROUND

Sellers or vendors of various goods, such as restaurant/food service operations, retail operations, grocery stores, and other sales and/or delivery operations increasing utilize self-service pick-up options for goods. The orders for such goods can in some cases be placed remotely, and in some cases the goods are pre-paid for such that the customer need only provide proof of purchase and/or confirm their identity before taking possession of the purchased items.

When the good are ready for pickup, the goods may be placed in a storage compartment while awaiting pickup. It may be desired to maintain the storage compartment at certain desired environmental conditions, such as temperature, pressure and/or humidity However, many existing systems do not provide sufficient control of environmental conditions.

SUMMARY

Accordingly, the current disclosure is directed to an order fulfillment system in which conditions in the storage compartment can be maintained at desired levels. More particularly, in one embodiment the invention is an order fulfillment system having a frame defining a compartment therein that extends between a first space and a second space, and a first door coupled to the frame. The first door is movable between an open position providing access to the compartment from the first space, and a closed position blocking access to the compartment from the first space. The system further includes a second door coupled to the frame, wherein the second door is movable between an open position providing access to the compartment from the second space, and a closed position blocking access to the compartment from the second space. The system is configured such that the compartment has greater fluid communication with the first space compared to the second space when the first door is in the closed position and the second door is in the closed position. The system also includes an air movement device in fluid communication with the first space and the compartment, wherein the air movement device is configured to provide air from the first space into the compartment.

DETAILED DESCRIPTION

Figure 1:
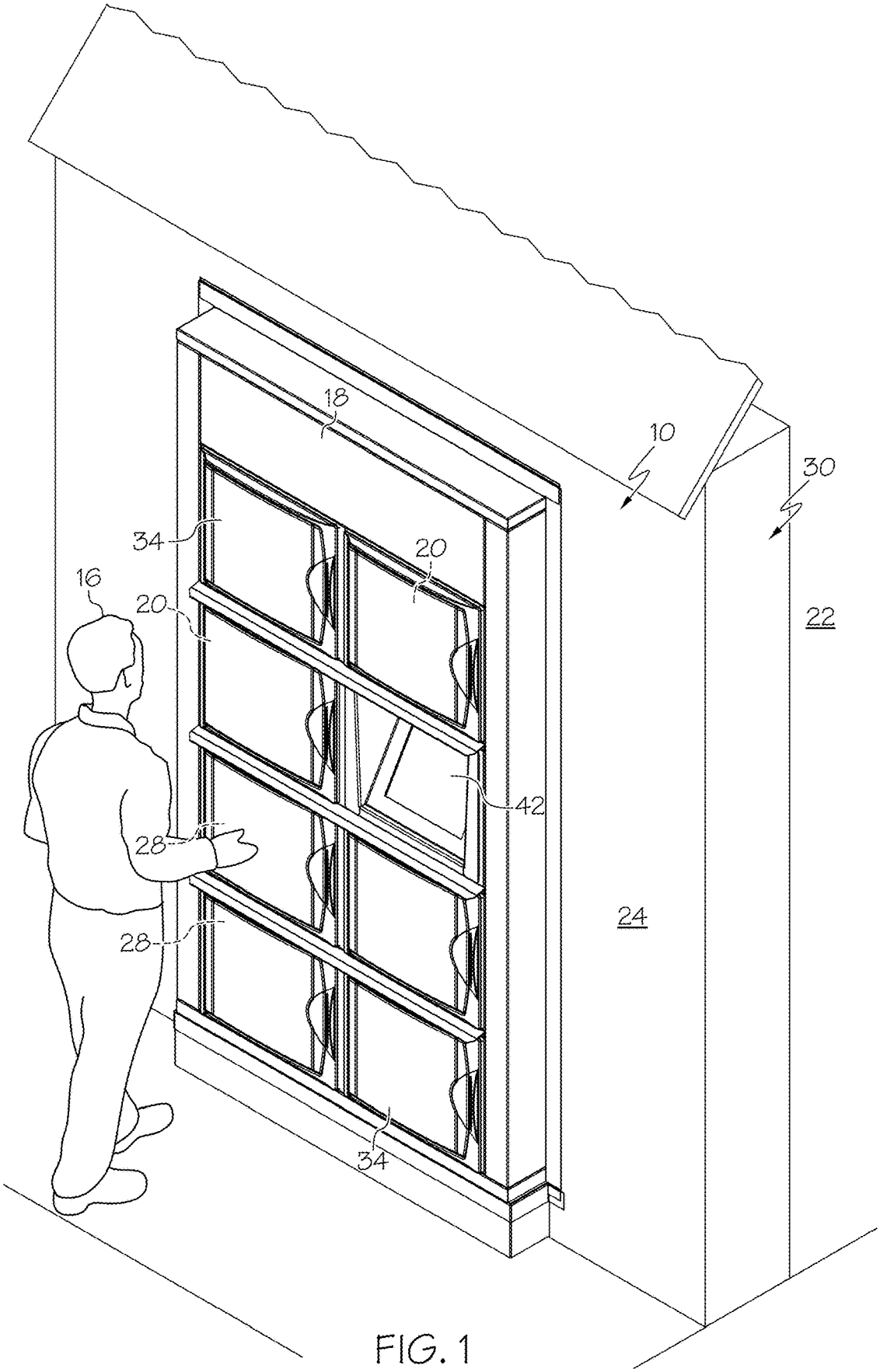
FIG. 1 is a perspective exterior view of one embodiment of an order fulfillment system, shown in conjunction with a portion of a building.

The order fulfillment system 10 disclosed herein can be utilized to enable or facilitate the transfer of any of a variety of products, items or the like (collectively termed an item 12 and shown schematically in the drawings). The system 10 can be utilized in conjunction with nearly any type of item 12 that can be physically accommodated in the system 10, including but not limited to food, beverages, groceries, pharmaceuticals, retail merchandise, parts, components, work pieces, hardware, and the like. The items 12 forming part of or used in conjunction with the system 10 can in some cases take the form of or include a consumable item and/or associated packaging. However, the item 12 can also or instead take the form of various items packaged or bundled together, such as numerous items in a box, bag, carrier or the like. Moreover, the item 12 could in one case take the form of a token that entitles the bearer to a product or service, such as an empty soda cup that can be filled by the bearer.

In one case item 12 is transferred from or between two users or parties, termed a "stocking" party 14 and a "retrieving" party 16 herein. In many cases title/ownership of the item 12 is being, has been or will be transferred from the stocking party 14 to the retrieving party 16, such as in a sale transaction. However, title may not necessarily transfer in the transaction, for example when items 12 are dispensed by a company or facility for use by its employees or other authorized personnel, or when the system 10 is used in a lending or leasing arrangement and/or to return an item 12 to the stocking party 14 in a return transaction or the like.

With reference to FIGS. 1-9, the order fulfillment system 10 can include a frame 18 that defines one or more compartments or passageways 20 therethrough. Each compartment 20 can extend an entire thickness of the frame 18 between a first or stocking side or space 22 and a second or retrieval side or space 24 thereof. Each compartment 20 can be sized to store/receive an item 12 to be delivered to the retrieving party 16. Each compartment 20 has or terminates at an first or stocking end or opening 26 on the first or stocking side/space 22 of the frame 18, and a second or retrieval end or opening 28 on the second or retrieval side/space 24 thereof.

Figure 5:
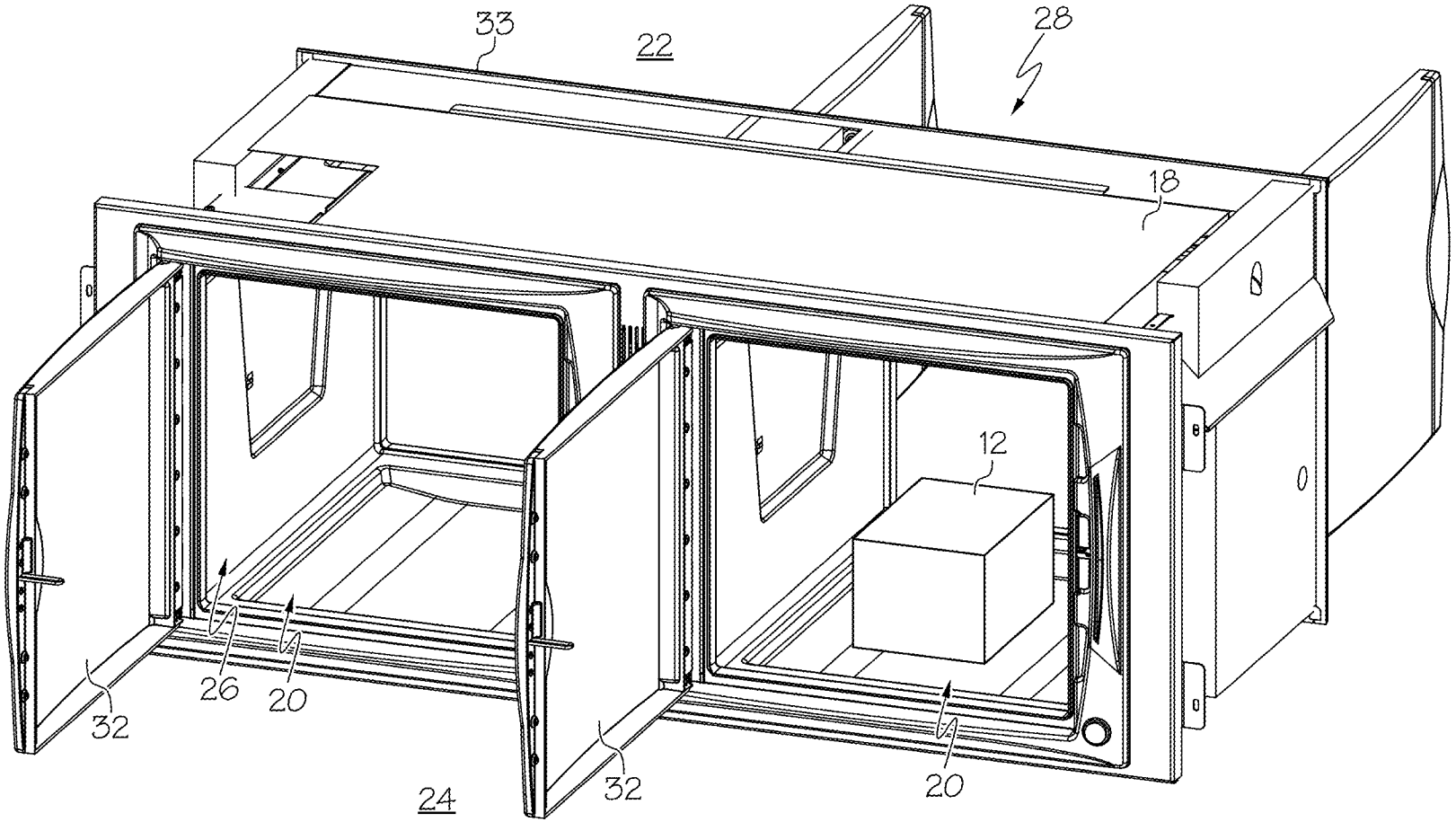
FIG. 5 is a front perspective view of two compartments of the order fulfillment system of FIG. 1, with the doors in their open positions.
Figure 6:
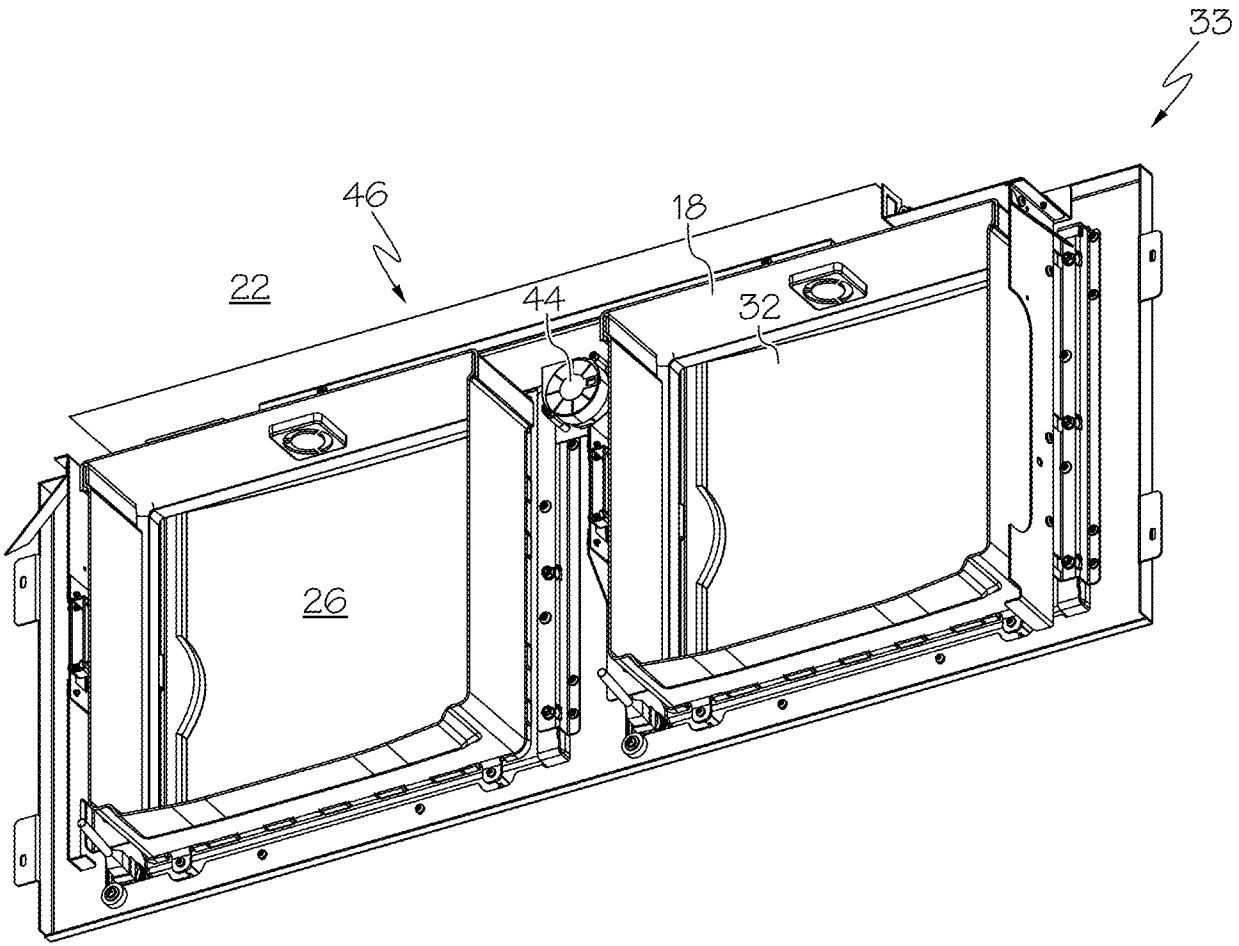
FIG. 6 is an interior view of the casing of the compartments of FIG. 5.

The frame 18 can, in one case as shown in FIGS. 1-4, be positioned in a wall, partition or the like 30 such as an exterior wall in one case, wherein the stocking side/space 22 is positioned on one side of the wall 30 and the retrieval side/space 24 is positioned on the other side of the wall 30. When the wall 30 is an exterior wall, the stocking space 22 can be an interior or conditioned space, wherein the air in the conditioned space is temperature, pressure and/or humidity controlled, by use of for example air conditioners, furnaces or heaters, heat pumps or other HVAC appliances, humidifiers, dehumidifiers, fans, air movement devices, etc. As shown in FIGS. 5 and 6, the system 10/frame 18 can including a facing/casing 33 on the side facing the stocking space 22, and a rear view/interior view of the casing 33 is shown in FIG. 6.

The stocking space 22, or at least the portion of the stocking space to which the stocking opening 26 of the compartments 20 are exposed, can in some cases be a restricted-access area, such as cooking areas or working areas of a restaurant, and/or stocking rooms, warehouses or the like where customers or the general public are not permitted. When the wall 30 is an exterior wall, the retrieval space 24 can be an outside space constituting or exposed to the ambient environment, and/or a space that is un-conditioned, or less conditioned than the stocking space 22 (e.g. a partially sheltered and/or partially enclosed space, or a vestibule, etc.).

In this manner each compartment 20 can have the first end 26 positioned immediately adjacent to or in the stocking space 22, and the second end 28 positioned immediately adjacent to or in the retrieval space 24. In some cases, the system 10 may be configured or arranged such that the retrieving party 16 only has access to the retrieval side 24 of the frame 18, and does not have access to the stocking space/side 22. For example, the frame 18 may be positioned in the wall 30, or itself form at least part of the wall 30, or be closely received in a correspondingly-sized opening in the wall 30 to prevent a retrieving party 16 from accessing the stocking space/side 22 of the system of frame 18.

The system 10 can be used to convey or enable conveyance of the item 12 from the stocking space 22 to the retrieval space 24, and thereby delivered to the retrieving party 16. Thus each compartment 20 can be or define a continuous cavity or opening extending through the frame 18 such that an item 12 to be dispensed is insertable into the compartment 20 in a first direction through the stocking end 26 of a compartment 20, and the item 12 is thereafter removable from the compartment 20 in the first direction through the opposite retrieval end 28 of the compartment 20. In certain cases, the item 12 passes in the opposite direction (e.g. from the retrieval space 24 to the stocking space 22, such as when an item 12 is returned). In some cases, movable, extendible or tiltable trays or the like (not shown) can be positioned within each compartment 20 to facilitate access and/or dispensing.

The various compartments 20 may have the same or different shapes or dimensions, as appropriate for the items 12 to be transferred. In one embodiment, the compartments 20 are generally rectangular in cross section and are between about 3 and about 24 inches wide (the roughly left-to-right dimension of the compartments 20 of FIG. 1), and/or between about 6 and about 24 inches high (the vertical dimension of the compartments 20 of FIG. 4), and/or between about 6 and about 36 inches deep (the left-to-right dimension of the compartments 20 of FIG. 4). The compartments 20 may alternately have any of a variety of other shapes or dimensions as appropriate for the items 12 to be stored or transferred.

The system 10, frame 18 and compartments 20 may be made of materials that comply with relevant standards issued by NSF International in relation to materials for use near or in contact with food, such as food storage, handling and/or dispensing equipment. In one case the compartments 20 can be made of or include a food-safe polymer material. In cases where the system 10 is to be used for dispensing liquids, the system 10, frame 18 and compartments 20 may be designed to accommodate fluid spills while ensuring continuing operation of the system 10. In one case for example, the system 10 may include fluid channels that route spilled fluid to a channel and/or a fluid-tight reservoir that can be periodically emptied or cleaned.

The system 10/frame 18 can include a first or stocking door 32 positioned at a stocking end 26 of each compartment 20, and located in/adjacent to the stocking space 22, and a second or retrieval door 34 positioned at a retrieval end 28 of each compartment 20, located in/adjacent to the retrieval space 24. Each door 32, 34 can be pivotable about a vertical hinge/axis positioned along one side of the compartment 20. Alternatively each door 32, 34 can be pivotable about different axes, be foldable, collapsible or slidable, be vertically movable along a set of rollers similar to a garage door, or have other movable arrangements to selectively cover the associated end/opening. Each door 32, 34 can be movable between a first or closed position (see closed doors of FIGS. 1, 3 and 4), where the door 32, 34 generally blocks the associated end 26, 28, and generally blocks manual access to the compartment 20 from the side 22, 24 on which the door 32, 34 is located, and a second or open position (see open doors in FIGS. 2-5, 7 and 9) where the door 32, 34 allows or does not generally block manual access to the end 26, 28 and/or compartment 20 from the side 22, 24 on which the door 32, 34 is located. Each door 32, 34 can thus provide access control features to limit access to contents of the compartments 20.

Each door 32, 34 may be able to be locked or secured in its closed position. In the illustrated embodiment each compartment 20 includes a single dedicated door 32, 34 at each end thereof. Alternatively in some cases, particularly but not limited to on the stocking side 22, a single door 32, 34 can cover or multiple compartments 20 when in the closed position. In one case, all or part of the doors 32, 34 can be transparent or translucent to provide at least some visibility into the associated compartment 20, and in other cases all or part of the doors 32, 34 can be generally opaque to block visibility into the associated compartment 20.

The order fulfillment system 10 can be configured to selectively control access to the compartments 20 from users or retrieving parties 16 on the retrieval side 24 of the system 10, or stocking parties 14 on the stocking side 22 of the system 10, or both, by allowing and/or restricting movement, opening, or locking/unlocking of the doors 32, 34. In one case, the order fulfillment system 10 may have and/or be operatively coupled to a controller 40 (FIG. 3) which can be operatively coupled to the doors 32, 34 and/or locks and associated solenoid and other components. The controller 40 may include or take the form of a controller, processor, CPU, computer or the like.

Figure 2:
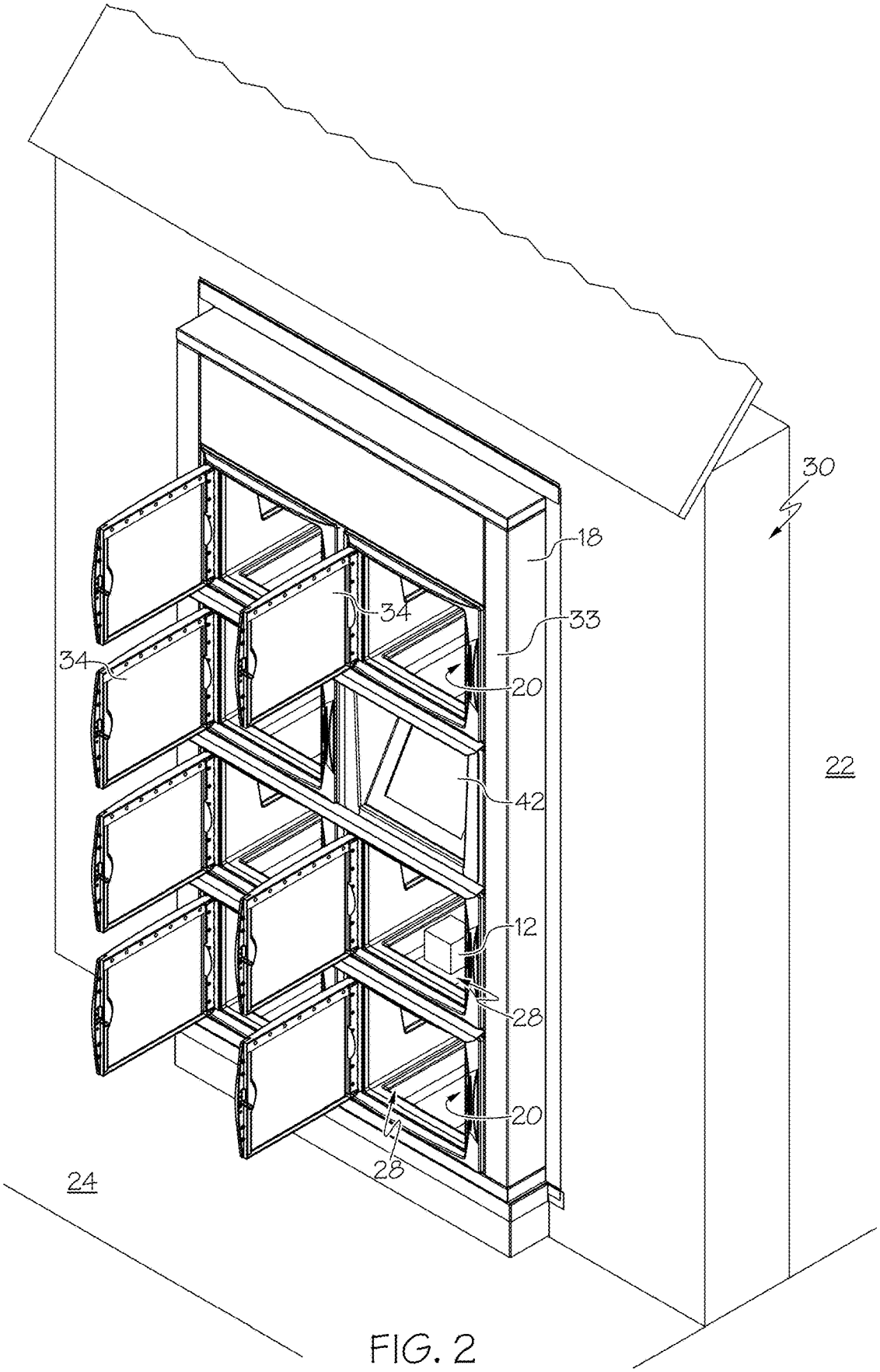
FIG. 2 is a front perspective view of the order fulfillment system of FIG. 1, with the doors in their open positions.
Figure 3:
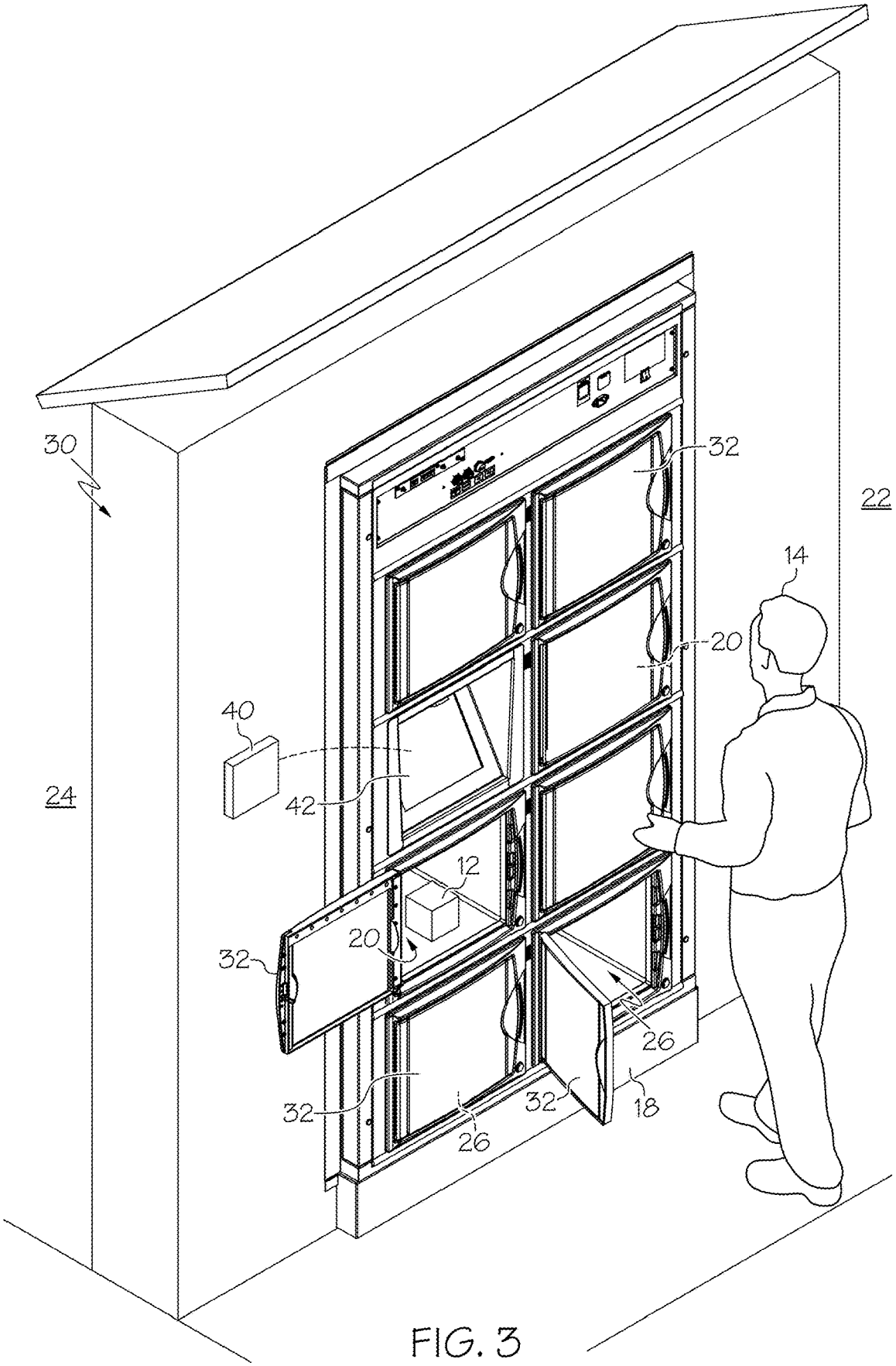
FIG. 3 is a perspective interior view of the order fulfillment system of FIG. 1.
Figure 4:
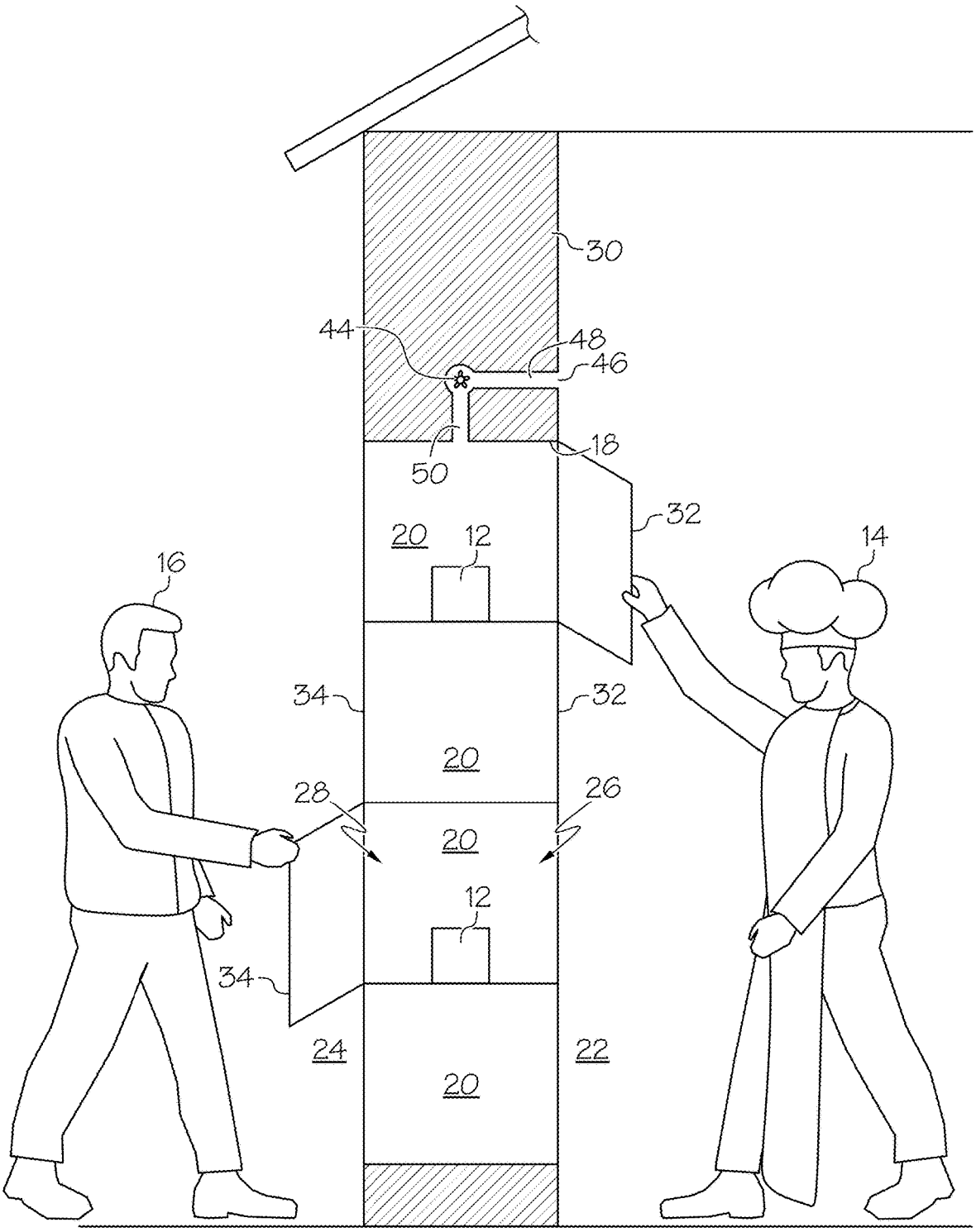
FIG. 4 is a schematic side cross section of the order fulfillment system of FIG. 1, shown in conjunction with a stocking party and a retrieving party.

The system 10 can include a user interface 42 that is operatively coupled to the controller 40. The user interface 42 can include or take the form of a keypad/keyboard (hard or virtual), monitor/display screen, touch screen, mouse, track ball, audio input device, or the like. The user interface 42 can also include or take the form of a scanner configured to scan a code (such as a barcode, including a 1 dimensional and/or 2 dimensional barcode such as a QR code or the like) displayed on a mobile device (such as a cellular phone, tablet or the like), or a printed code/barcode, and/or be configured to scan a hand or finger of a user for biometric identification, etc. A user/retrieving party 16/stocking party 14 may be able to interact with the user interface 42 to gain access to the appropriate compartment 20. The user interface 42 (or portions thereof) is shown in FIGS. 1-3 as being positioned on and accessible from both the retrieval side 24 and the stocking side 22, but the user interface 42 could instead or in addition be positioned on or accessible from only one side 22, 24 or have various other positions.

In some cases, the retrieving party 16 can present a code that is scanned by the user interface 42. Once the code is approved/authenticated then the user may be provided access to the appropriate compartment(s) 20 that store items 12 associated with the order of the retrieving party 16. Instead of or in addition to the scanner/sensor, the identification/authentication of the retrieving party 16 can be implemented or carried out in a variety of manners, including by the use of a user identification and/or password (such as via the user interface 42), the use of a key fob or other wireless device which transmits in the radio frequency range, a mechanical or electronic key, the use of a mobile phone or device, a card with a magnetic strip and/or chip in conjunction with a magnetic strip/card or chip reader, through receipt of payment via cash or credit card which transmits authentication to the controller 40, or various other means or mechanisms.

A retrieving party 16 may also be identified and/or make payment at the user interface 42 by mobile payment services that wirelessly communicate with point of sale systems using a near filed communication (NFC) antenna or the like, such as via APPLE PAY® services or software offered by Apple Inc. of Cupertino California, or GOOGLE PAY® services offered by Google LLC of Mountain View California, or by using a credit card reader at the user interface 42. Authentication of the user/retrieving party 16 may also be carried out by transmissions from a device in the possession or control of the retrieving party 16, such as a mobile device, that transmits a signal to the controller 40/user interface 42 via short-distance/short-range wireless communication technology/protocol such as a BLUETOOTH® transmission system for a low energy wireless technology.

The system 10 can include identifying indicia, such as numbers, letter or the like (not shown), positioned on and/or adjacent to each door 32, 34/compartment 20 so that the users 14, 16 can be guided to the appropriate door 32, 34/compartment 20. The system 10 can also or instead include light-emitting and/or sound-emitting components positioned on or adjacent to each door 32, 34/compartment 20/which can be activated to attract the attention of the retrieving party 16 (or the stocking party 14). Upon grant of access to a particular compartment(s) 20 via the controller 40, the associated door 32, 34 and/or indicia may automatically illuminate, flash, partially or fully open, or provide some other type of sensory output/effect to expedite identification of that door 32, 34/compartment 20.

Generally, the stocking party 14 may have broad or greater access to many or all of the compartments 20 from the stocking side 22, at least compared to the retrieval party 16. In contrast the access of the retrieving party 16 from the retrieval side 24 may be more limited and/or strictly limited to the particular compartment(s) 20/which contains the item(s) 12 that the retrieving party 16 is authorized to accesses or possess (for example, after verification by the controller 40 of payment for the associated item 12). However, access may alternately be more strictly or loosely controlled on either side 22, 24 of the system 10/frame 18 as appropriate for the particular application.

One embodiment of an ordering process incorporating or utilizing the order fulfillment system 10 will now be described, in the exemplary context of a fulfilling an order for food from a fast food restaurant, with the understanding that this embodiment is provided as an example only, and various features can be used, not used, or combined in various manners other than that described below. The order fulfillment system 10 is, in this example, positioned within the fast food restaurant with the stocking side 22 of the system 10/frame 18 facing a restricted access area, for example in an interior, conditioned space, such in a cooking and/or order assembly area, and the retrieval side 24 of the system 10/frame 18 facing an outer location generally accessible to the public. In the default/starting configuration, all of the doors 32, 34 are in their closed positions, and at least the retrieval doors 34 are locked.

A customer/retrieving party 16 can place an order with the restaurant at a location remote from the restaurant, or (in one case) other than in a face-to-face transaction, for example through an internet website, a mobile application, a phone call, a fax order, or the like. Alternately, the order can be place via an in-person interaction with an on-site cashier, such as in a drive-through, or even from inside the restaurant. The order can be automatically or manually inputted into a computer system, point-of-sale device, etc., which can constitute or be in communication with the system 10/controller 40. The order can be remotely paid for by the retrieving party 16 by, for example their mobile device, or paid for on-site or at the location of pick-up of the item 12.

A server (e.g. the stocking party 14) then prepares the food order, and once complete, prepares to load the order 12 into one or more of the plurality of compartments 20 of the order fulfillment system 10 from the stocking side 22 of the system 10/frame 18. In one embodiment, the controller 40 selects the appropriate compartment(s) 20 for the stocking party 14 to use based upon size of the order, availability of the compartment(s) 20, expected pick-up time, accessibility/location of the compartment(s) 20, etc. The controller 40 then identifies the automatically selected compartment(s) 20 to the stocking party 14 via a video display/user interface 42, indicia on the frame 18 and/or doors 32, 34, or the like, and may open/unlock the associated door(s) 32 on the stocking side 22.

In another embodiment, the stocking party 14 determines the compartment(s) 20 in which to place the order/item 12. In either case the order fulfillment system 10 can include weight sensors, cameras and/or other types of sensors in communication with the controller 40 to automatically determine that the order 12 is positioned in a compartment 20 or compartments 20 and ready for retrieval. Alternatively or in addition, the controller 40 may be programmed to recognize that for a specific compartment(s) 20, opening the associated stocking door 32, followed by closing of the door 32 (within a predetermined period of time, in one case), indicates that an order 12 is positioned in the compartment (s) 20. In yet another embodiment, the stocking party 14 manually inputs, for example via the user interface 42, the compartment(s) 20 in which the order/item 12 is positioned.

To access the appropriate compartment(s) 20 and insert the order, the stocking party 14 opens the appropriate stocking door(s) 32. Access to the compartment(s) 20 by the stocking party 14 can in some cases be open (unrestricted), or access can be controlled for each compartment(s) 20 via, for example, a locking device (not shown) for the associated doors 32.

The controller 40 may signal to the retrieving party 16 that the order 12 is fulfilled and ready for pick-up, for example with a text message (sms message), email, or other communication via mobile device, audio or visual signal, through interaction with a vibrating signal device, providing an output from the frame 18 and/or compartment 20 via an output on the user interface 42 or a display screen, or any of a variety of other signaling methods. The retrieval door(s) 34 may illuminate, flash, make a sound, or otherwise provide additional signals to direct the retrieving party 16 to the proper compartment(s) 20 containing the retrieving party's item(s) 12. In some cases the signaling may only occur after payment for the item(s) 12 has been received and/or when the retrieving party 16 is authenticated by the user interface 42 so that the controller 40 knows that the retrieving party 16 is physically present.

The signal from the controller 40 and/or information provided to the retrieving party 16 at the time of purchase may also include additional information for the retrieving party 16, such as the identity (e.g. compartment number or door number) of the specific compartment(s) 20/door(s) 34 which contains the order 12, a summary of the order contents, the amount of the payment due (if any), a receipt indicating payments made, instructions or information for retrieval of the order (such as providing access codes or a scannable code), and the like.

Once the order 12 is stocked, the retrieving party 16 approaches the order fulfillment system 10 from the retrieval side 24 of the system 10/frame 18. The compartments 20/doors 34 may be locked from the retrieval side 24 so that the controller 40 can control the access of the retrieving party 16 to the appropriate compartment 20. The controller 40 can prevent opening of the appropriate door 34 unless and until the controller 40 determines that an approved transaction has occurred, or the controller 40 otherwise receives information regarding approval of the transaction and/or dispensing.

Once the controller 40 verifies/authenticates the retrieving party 16 and/or grants access, the controller 40 can unlock the door(s) 34 and/or fully or partially opens the retrieval door(s) 34 of the compartment(s) 20 associated with the retrieving party's order/items 12. Once the retrieval door(s) 34 are open, the retrieving party 16 may manually access and retrieve the food/beverage order or other item 12 from the compartment(s) 20 to complete the transaction.

Optionally, the system 10 may include sensors to monitor whether the item 12 has actually been removed from the compartment(s) 20/system 10. In one embodiment, the order fulfillment system 10 may send an alert or message (e.g., an audio or visual signal, or digital signal via email, push, web, sms, etc.) if a retrieval door 34 is not closed after order retrieval, to notify the stocking party 14. In another embodiment, the system 10/frame 18 may include a mechanism to automatically close and/or lock the retrieval door(s) 34 after the items 12 have been retrieved. Alternatively or in addition, the controller 40 may be programmed to recognize that for a specific compartment(s) 20, opening the associated retrieval door 34, followed by closing of the door 34 (within a predetermined period of time, in one case), indicates that an order 12 has been successfully retrieved. If the retrieving party 16 does not retrieve the item(s) 12 within a predefined period of time, the controller 40 may send a follow-up alert to the retrieving party 16 and/or the stocking party 14 to indicate that the item(s) 12 has not been picked-up. This feature can be particularly useful for items 12 that are desired to be served heated or cooled and/or for items which should be received in a time sensitive manner.

Since, in many cases, one of the spaces 22, 24 is conditioned and the other space 22, 24 is not conditioned (or is lesser conditioned), it may be desired for each compartment 20 to have greater air/fluid communication with the first space 22 as compared to the second space 24 (or, in some cases in appropriate circumstances, vice versa). For example, when the stocking space 22 is a conditioned space, and the retrieval space 24 is not conditioned space (or is less conditioned that the stocking space), it may be desired for one or each compartment 20 to have greater fluid communication with the stocking space 22. This arrangement allows for greater control of temperature, humidity and/or pressure in the compartments 20. More particularly, the stocking space 22 can have more controlled and predictable conditions than the retrieval space 24, which in one case can be located outside and thus can present extremely hot, cold, dry, moist and/or high/low pressure conditions that can adversely affect the state of the stored items 12.

By providing greater fluid communication between the compartments 20 and the stocking space 22, the air and associated conditions of the stocking space 22 enter the compartments 20 relatively freely and/or the air in the compartments 20 relatively freely exits the compartments 20 to the stocking space 22. The fluid communication between the compartments 20 and the stocking space 22 can in one case be provided by having a relatively compromised seal between the stocking doors 32 and the frame 18. In this case, even when the stocking doors 32 are closed, the stocking doors 32 may form an imperfect, or non-airtight seal, by omitting certain seals, weather stripping, gaskets, insulation etc. and/or by providing seals, weather stripping, gaskets or insulation that are compromised, imperfectly fit, etc. In an alternative embodiment, the stocking doors 32 and/or frame 18 may include one or more vents, holes, openings, etc. that provide fluid communication between the stocking space 22 and the compartments 20.

In contrast, the system 10 may provide better seals, and thereby less fluid communication, between the compartments 20 and the retrieval side/space 24. Thus the retrieval doors 34 may form an airtight seal with the frame 18 (or a more airtight seal than the stocking doors 32), and/or the system 10 can lack any vents, holes or openings that provide direct and/or indirect fluid communication between the compartments 20 and the retrieval space 24.

The system 10 can also include an air movement device, such as a fan, impeller, blower, reservoir of compressed air/gas, or the like and/or source of relatively high pressure air 44 (FIGS. 4 and 6-8), that is in fluid communication with the stocking space 22 and one or more of the compartments 20. The air movement device 44 can be configured to provide air and/or increased pressure directly from the stocking space 22 (and in one case, not from the retrieval space 24) into the one or more compartments 20. In particular, the air movement device 44 can include or be fluidly coupled to an inlet 46 (FIGS. 4, 7 and 8) that takes in air directly from the stocking space 22 (and not from the retrieval space 24 in one case), passes the intake air through air flow passages/ductwork 48 that is in fluid communication with the inlet 46 and air movement device 44, and provides air through an outlet 50 (FIGS. 4, 8 and 9) into the compartment 20. The air movement device 44 can be positioned in, and/or in fluid communication with, the air flow passage 48.

Figure 7:
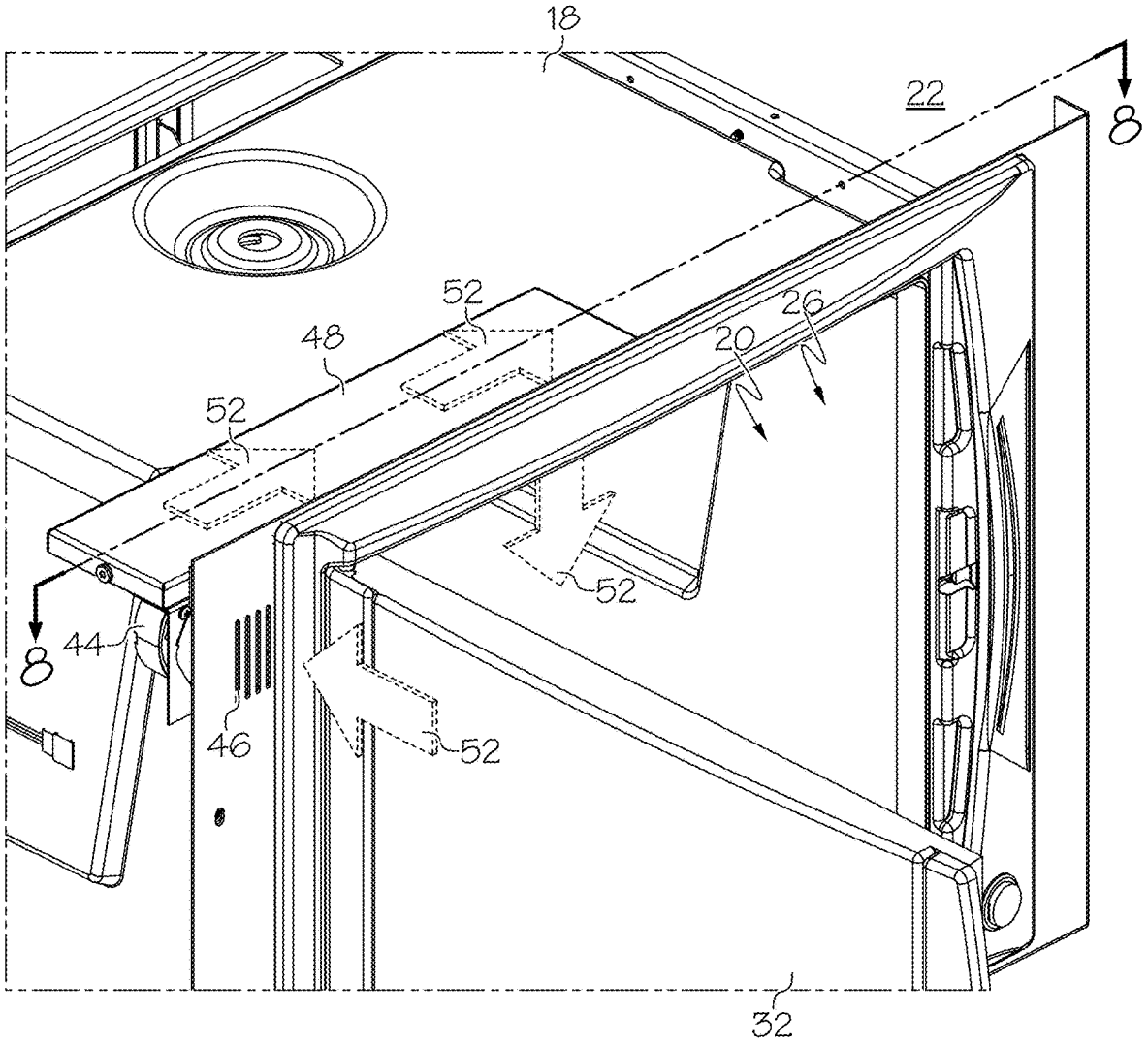
FIG. 7 is an upper perspective view of one of the compartments of FIG. 5, with the door in the open position.
Figure 8:
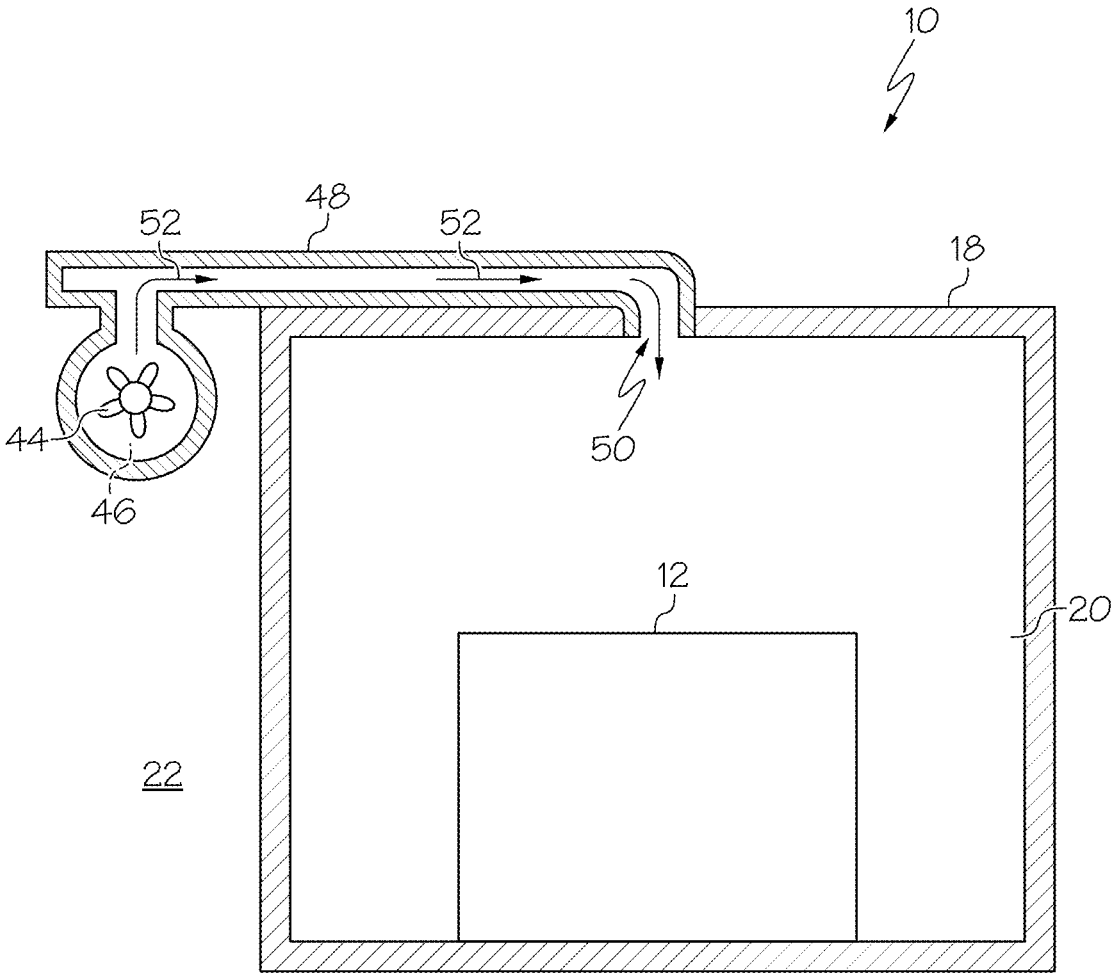
FIG. 8 is a schematic cross section taken along line 8-8 of FIG. 7.
Figure 9:
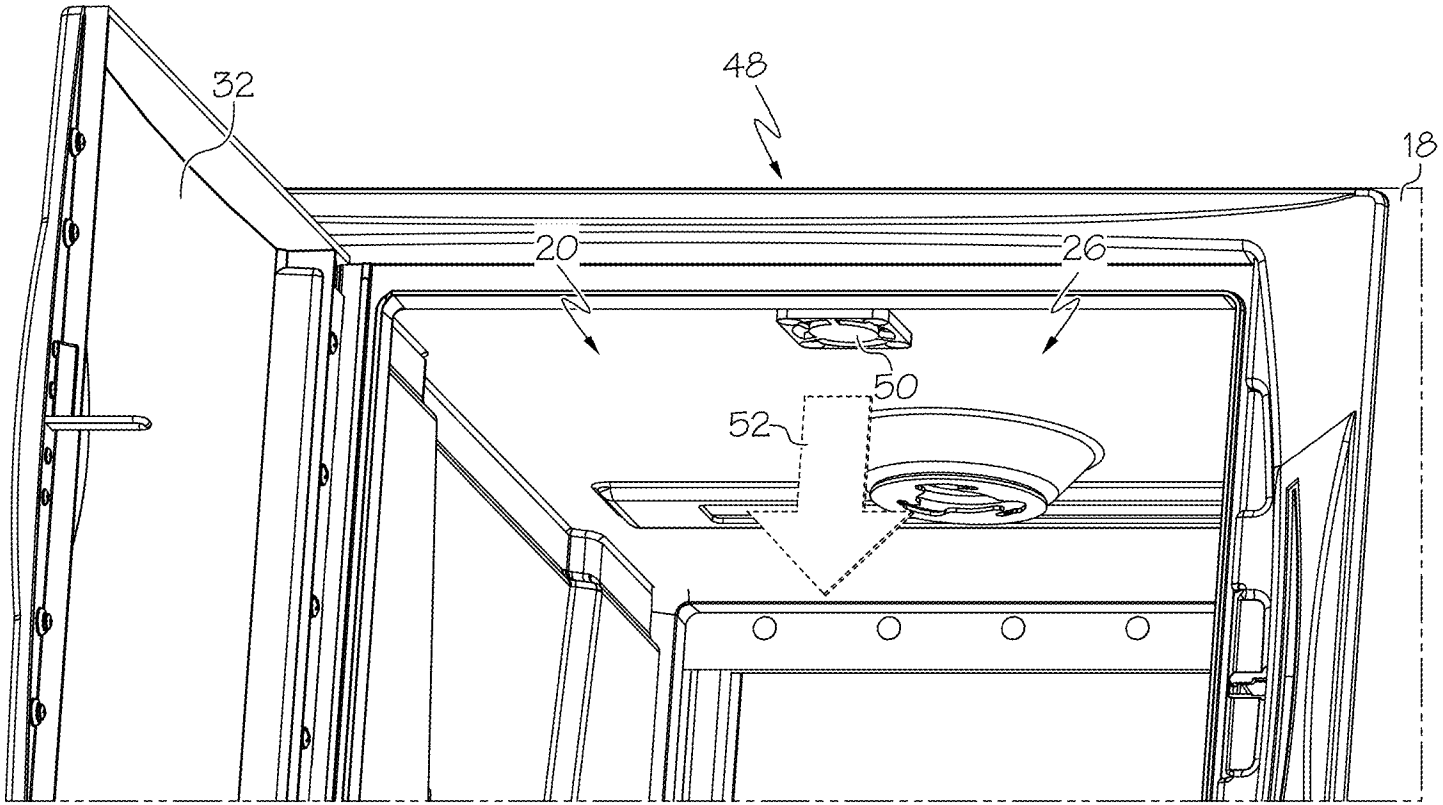
FIG. 9 is a lower perspective view of the compartment of FIG. 7.

The movement of air from the stocking space 22 into the compartment 20 is shown by the arrows 52 of FIGS. 7-9. However, it should be understood that the air movement device 44, inlet 46, ductwork 48 and/or outlet 50 can take various configurations and be located at differing locations that that shown herein, including being located in the associated stocking door 32 in some cases. In addition, a single air movement 44 device can be fluidly couple to multiple compartments 20 so that a single air movement device 44 can provide incoming air/fluid flow to a plurality of compartments 20. If desired, an air filter or filters can be positioned in the air movement device 44, inlet 46, ductwork 48 and/or outlet 50.

The air movement device 44 can be rated to provide and/or actually provide an airflow to each compartment 20 of, in one case, between about 0.5 and about 10 cubic feet/min (CFM), or in another case between about 2 and about 5 CFM. In one case, the air movement device 44 can provide air to more than one compartment 20, can be a DC fan/blower rated for between about 2 to about 5.4 CFM per compartment 20 served. For example, the air movement device 44 can take the form of or include a fan/blower that supplies air to two compartments 20, and supplies a minimum of 1.35 CFM to each compartment 20, in which case a 2.7 CFM (minimum) fan can be utilized.

The system 10 can be configured such that each compartment 20 has at least some limited fluid communication with the stocking space 22 when the associated stocking door 32 is closed. In particular, each compartment 20 can be configured that when air is introduced into the compartment 20 using the air movement device 44 providing air from the stocking space 22 to that compartment 20 at 3.5 CFM while the doors 32, 34 are closed, a small (increased) steady state differential pressure is maintained in the compartment 20 compared to the stocking space 22. The difference in pressure can be between about 0.01 inch water column and about 0.1 inch water column in one case, or greater than about 0.01 inch water column in another case, or greater than about 0.005 inch water column in yet another case, or less than about 0.1 inch water column in one case, or less than about 0.05 inch water column in yet another case. In yet another case the difference in pressure can be between about 0.01 inches Hg and about 0.025 inches Hg.

The system 10 can further be configured such that each compartment 20 has a rate of fluid communication with the retrieval space 24, when the associated doors 32, 34 are fully closed (latched and/or locked), which is less than about ½ (or ¼ or less, or ⅛ or less, or 1/10 or less, in one case as low as zero) of the rate of fluid communication to the stocking space 22 under the same conditions (in one case under the condition where the retrieval space 24 is at the same pressure as the stocking space 22, and air is provided to the compartment 20 at 3.5 CFM). Under these conditions, less than ½ of the air exiting the compartment 20 is conveyed to the retrieval space 24, and the remaining greater than ½ of the air exiting the compartment 20 is conveyed to the stocking space 22. In another case, under these conditions less than 25% of the air exiting the compartment 20 is conveyed to the retrieval space 24, and the remaining at least 75% of the air exiting the compartment is conveyed to the stocking space 22, and in another case, less than 1%/5%10% of the air exiting the compartment 20 is conveyed to the retrieval space 24, and the remaining at least 99%/95%/90% of the air exiting the compartment 20 is conveyed to the stocking space 22.

The arrangement of seals and the air movement device 44 helps to ensure desired conditions are maintained in the compartments 20. For example, during a cold winter day the retrieval door 34 of the compartment 20 may be opened by a retrieving party 16 to access the items 12, which in one case may be desired to be kept warm. During this process cold, dry air may naturally flow into the compartment 20, and that air is trapped in the compartment 20 after the retrieval door 34 is closed. However, after the retrieval door 34 is closed (or even while the retrieval door 34 is open), the air movement device 44 can introduce more desirable conditions (relatively warmer, moister air in this example) into the compartment 20, from the stocking space 22. This also causes the undesirable (cold, dry) air to be exhausted from the compartment 20 into the stocking space 22, where it is easily mixed/dissipated and accommodated by the HVAC system or other conditioning systems associated with the stocking space 22. The air movement device 44 thus helps to ensure conditions inside the compartment 20 are relatively quickly returned to desired levels. The system 10 thereby retains the compartments 20 at desired conditions so that the items 12 are in turn better maintained for storage and dispensing. However, it may be desired to limit the amount of air communication and/or the pressure differential between the compartments 20 and the stocking space 22, since the compartments 20 may be desired to be maintained at different conditions than the stocking space 22. For example, if the item 12 is hot, the compartment 20 may be desired to trap the heat of the item 12 in the compartment 20.

The air movement device 44 can run continuously, or intermittently, for example when conditions inside the compartments 20 are measured/sensed to drop below a desired threshold. In yet another case the air movement device 44 can be set to run each time an associated retrieval door 34 is opened, and run for a predetermined period of time, or until measured conditions reach the desired level. Thus various sensors (moisture sensors, temperature sensors, pressure sensors or the like) can be located in or operatively coupled to the compartments 20.

When the air movement device 44 is operating, or after the air movement device 44 has been operated, the compartments 20 may thus be maintained at a relatively higher pressure than the stocking side 22 and/or retrieval side 24 at a positive pressure of between about 0.01 inches Hg and about 0.025 inches Hg in one case. In this case, when the retrieval door 34 is opened, air can exit from the compartment 20 into the retrieval space 24. This can help to minimize dirt and contaminants from the retrieval side 24 entering into the compartments 20, and act as a rudimentary airlock.

Although the invention is shown and described with respect to certain embodiments, it should be clear that modifications will occur to those skilled in the art upon reading and understanding the specification, and the present invention includes all such modifications.

What is claimed is:

1. An order fulfillment system comprising:

a frame defining a compartment therein that extends between a first space and a second space;

a first door coupled to the frame, wherein the first door is movable between an open position providing access to the compartment from the first space, and a closed position blocking access to the compartment from the first space;

a second door coupled to the frame, wherein the second door is movable between an open position providing access to the compartment from the second space, and a closed position blocking access to the compartment from the second space, wherein the system is configured such that the compartment has greater fluid communication with the first space compared to the second space when the first door is in the closed position and the second door is in the closed position; and an air movement device in fluid communication with the first space and the compartment, wherein the air movement device is configured to provide air from the first space into the compartment.

2. The system of claim 1 wherein the second door is configured to provide an airtight seal with the compartment when the second door is in the closed position.

3. The system of claim 1 wherein at least one of: 1) the first door is configured to not provide an airtight seal with the compartment when the first door is in the closed position; or 2) the system includes a vent providing fluid communication between the compartment and the first space when the door is in the closed position.

4. The system of claim 1 wherein the compartment is configured such that when the first and second doors are closed, and when air is introduced into the compartment from the first space at a rate of 3.5 CFM, a steady state differential pressure is maintained in the compartment compared to the first space, where the difference in pressure is greater than about 0.01 inch water column.

5. The system of claim 1 wherein the compartment is configured such that when the first and second doors are closed, and when air is introduced into the compartment from the first space at a rate of 3.5 CFM, a steady state differential pressure is maintained in the compartment compared to the first space, where the difference in pressure is less than about 0.1 inch water column.

6. The system of claim 1 wherein the compartment is configured such that when the first and second doors are closed, and when air is introduced into the compartment from the first space at a rate of 3.5 CFM, a steady state differential pressure is maintained in the compartment compared to the second space, where the difference in pressure is greater than about 0.01 inch water column.

7. The system of claim 1 wherein the system is configured such that, when the first and second doors are closed, when the first and second spaces are maintained at the same pressure, and the compartment is at an elevated pressure relative to the first and second spaces, the compartment has a fluid communication with the second space less than about 10% of a fluid communication of the compartment with the first space.

8. The system of claim 1 wherein the first space is a generally enclosed, conditioned space, and wherein the second space is not a conditioned space.

9. The system of claim 1 wherein the second space is an outside space constituting or exposed to the ambient environment, and wherein the first space is an indoor space configured to be maintained at least one of a temperature, humidity or pressure that is different from that of the second space.

10. The system of claim 1 wherein the first door is positioned in the first space and the second door is positioned in the second space.

11. The system of claim 1 wherein the first and second doors are each pivotally coupled to the frame.

12. The system of claim 1 further comprising a wall separating the first space and the second space, and wherein the frame is positioned in the wall and the compartment extends through the wall.

13. The system of claim 1 further comprising a controller operatively coupled to the second door to at least one of lock or unlock the second door in the closed position.

14. The system of claim 13 wherein the controller is configured to retain the second door in a locked state unless the controller determines that an approved transaction has occurred or unless the controller receives information that an approved transaction has occurred, after which the controller is configured to unlock the second door.

15. The system of claim 13 wherein the controller is configured to receive an input relating to a proof of purchase of an item and to thereafter provide access to a user to the compartment.

16. The system of claim 1 wherein the compartment extends continuously through the frame and has a first opening at a first end thereof on a first side of the frame and a second opening at a second, opposite end thereof on a second side of the frame.

17. The system of claim 1 wherein the system is configured such that an item to be dispensed is insertable into the compartment and in a first direction through a first end of the compartment, and wherein the item is thereafter removable from the compartment in the first direction through a second opposite end of the compartment.

18. The system of claim 1 wherein the frame defines a plurality of compartments.

19. The system of claim 1 further comprising a presence sensor system configured to sense at least one of the presence, absence, placement or removal of an item in the compartment.

20. The system of claim 1 wherein the air movement device is configured to provide air directly from the first space into the compartment, and wherein the air movement device is not configured to provide air from the second space into the compartment.

21. The system of claim 1 further comprising an air flow passage in fluid communication with the first space and the compartment, and wherein the air movement device is in fluid communication with the air flow passage.

22. An order fulfillment system comprising:

a frame defining a compartment;

a first door coupled to the frame, wherein the first door is movable between an open position and a closed position to provide or block access to the compartment, respectively;

a second door coupled to the frame, wherein the second door is movable between an open position and a closed position to provide or block access to the compartment, respectively, wherein the compartment has greater fluid communication with a first side of the frame compared to a second, opposite side of the frame when the first door and the second door are both in the closed position; and an air movement device configured to provide air from the first side of the frame into the compartment.

23. A method comprising:

accessing an order dispensing system including a frame defining a compartment therein that extends between a first space and a second space, a first door coupled to the frame, wherein the first door is movable between an open position providing access to the compartment from the first space, and a closed position blocking access to the compartment from the first space, a second door coupled to the frame, wherein the second door is movable between an open position providing access to the compartment from the second space, and a closed position blocking access to the compartment from the second space, wherein the system is configured such that the compartment has greater fluid communication with the first space compared to the second space when the first door is in the closed position and the second door is in the closed position, and an air movement device in fluid communication with the first space and the compartment and configured to provide air from the first space into the compartment;

positioning an item in the compartment;

notifying a receiving party that the item is ready for pickup; and enabling the receiving party to access the compartment from the second space and remove the item from the compartment.

24. The method of claim 23 further comprising, after the receiving party has accessed the compartment, causing or enabling the air movement device to operate to move air from the first space into the compartment.

* * * * *